US010817010B2

(12) United States Patent
Hauschopp

(10) Patent No.: US 10,817,010 B2
(45) Date of Patent: Oct. 27, 2020

(54) PEDAL DEVICE WITH HINGE PART

(71) Applicant: AB ELEKTRONIK GMBH, Werne (DE)

(72) Inventor: Marion Hauschopp, Ascheberg (DE)

(73) Assignee: AB ELEKTRONIK GMBH, Werne (DE)

( * ) Notice: Subject to any disclaimer, the term of this patent is extended or adjusted under 35 U.S.C. 154(b) by 0 days.

(21) Appl. No.: 16/315,078

(22) PCT Filed: Oct. 9, 2017

(86) PCT No.: PCT/EP2017/075698
§ 371 (c)(1),
(2) Date: Jan. 3, 2019

(87) PCT Pub. No.: WO2018/065633
PCT Pub. Date: Apr. 12, 2018

(65) Prior Publication Data

US 2019/0310680 A1 Oct. 10, 2019

(30) Foreign Application Priority Data

Oct. 7, 2016 (DE) ..... 10 2016 119 088

(51) Int. Cl.
*G05G 1/44* (2008.04)
*G05G 1/50* (2008.04)

(52) U.S. Cl.
CPC ..... *G05G 1/506* (2013.01); *G05G 1/44* (2013.01)

(58) Field of Classification Search
CPC . B60K 26/02; G05G 1/44; G05G 1/50; G05G 1/506; G05G 1/30
See application file for complete search history.

(56) References Cited

U.S. PATENT DOCUMENTS 5,794,489 A * 8/1998 Papenhagen ..... B60K 26/02 74/513
6,851,333 B2 * 2/2005 Apel ..... B60K 26/021 74/513

(Continued)

FOREIGN PATENT DOCUMENTS

CN 201302680 Y 9/2009
DE 1857356 8/1962

(Continued)

OTHER PUBLICATIONS

PCT International Search Report and Written Opinion for corresponding PCT Application No. PCT/EP2017/075698, dated May 28, 2018, 15 pages.

(Continued)

*Primary Examiner* — Luis A Gonzalez
(74) *Attorney, Agent, or Firm* — Dority & Manning, PA

(57) ABSTRACT

In one example, a pedal device includes a base element, for example, to be arranged in a footwell, and a pedal element which is pivotably moveable with respect to the base element. The pedal element is connected to the base element via a hinge. The hinge includes a belt band having a first section and a second section. The first section is fastened to the base element and the second section is fastened to the pedal element. A particularly simple and cost-effective pedal device having stable articulation can be obtained due to the use of a belt band.

17 Claims, 2 Drawing Sheets

(56) References Cited

U.S. PATENT DOCUMENTS

| | | | | |
|---|---|---|---|---|
| 8,997,605 | B2 * | 4/2015 | Fuller | G05G 1/44 74/513 |
| 2007/0151398 | A1 | 7/2007 | Min et al. | |
| 2007/0193401 | A1 * | 8/2007 | Campbell | B60K 26/02 74/560 |
| 2010/0319480 | A1 * | 12/2010 | Nebuya | G05G 1/36 74/513 |

FOREIGN PATENT DOCUMENTS

| | | |
|---|---|---|
| DE | 1455910 | 6/1969 |
| DE | 71 22 063 | 4/1972 |
| DE | 33 20 052 | 10/1984 |
| DE | 195 31 734 | 3/1997 |
| DE | 199 10 309 | 9/1999 |
| DE | 103 28 554 | 1/2005 |
| DE | 20 2007 000 827 | 3/2007 |
| DE | 10 2012 221 406 | 5/2014 |

OTHER PUBLICATIONS

PCT International Preliminary Report on Patentability for corresponding PCT Application No. PCT/EP2017/075698, dated Apr. 9, 2019, 9 pages.

* cited by examiner

PEDAL DEVICE WITH HINGE PART

CROSS-REFERENCE TO RELATED APPLICATIONS

The present application is a 371 of International Application No. PCT/EP2017/075698 filed on Oct. 9, 2017, which claims priority to German Application No. DE102016119088.8 filed on Oct. 7, 2016 and is hereby incorporated by reference in its entirety for all purposes.

FIELD

The present disclosure relates generally to a pedal device.

BACKGROUND

Pedal devices are utilized, in particular, in motor vehicles, as operating and control elements for foot operation, for example, as a brake pedal for activating a brake or as an accelerator pedal (gas pedal), in the case of which the pedal position, i.e., the degree of deflection of a pedal element with respect to a base element, is utilized for controlling the drive power of the engine.

Pedals can be made of plastic, which is injected or cast in one piece, wherein the hinge is formed by a thin-walled plastic part. The entire pedal can be, as one piece, of polypropylene.

Gas pedals for motor vehicles can include two parts which are connected to one another via a film hinge. The two parts of the gas pedal as well as the film hinge are produced as one part via plastic injection molding. The film hinge is secured with the aid of a retaining ring made of a nylon- or thin-braided steel cord.

SUMMARY

Aspects and advantages of embodiments of the present disclosure will be set forth in part in the following description, or may be learned from the description, or may be learned through practice of the embodiments.

One example aspect of the present disclosure is directed to a pedal device. The pedal device includes a base element. The pedal device includes a pedal element pivotably moveable with respect to the base element. The pedal element can be connected to the base element via a hinge. The hinge can include a belt band including a first section and a second section. The first section can be fastened to the based element. The second section can be fastened to the pedal element.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
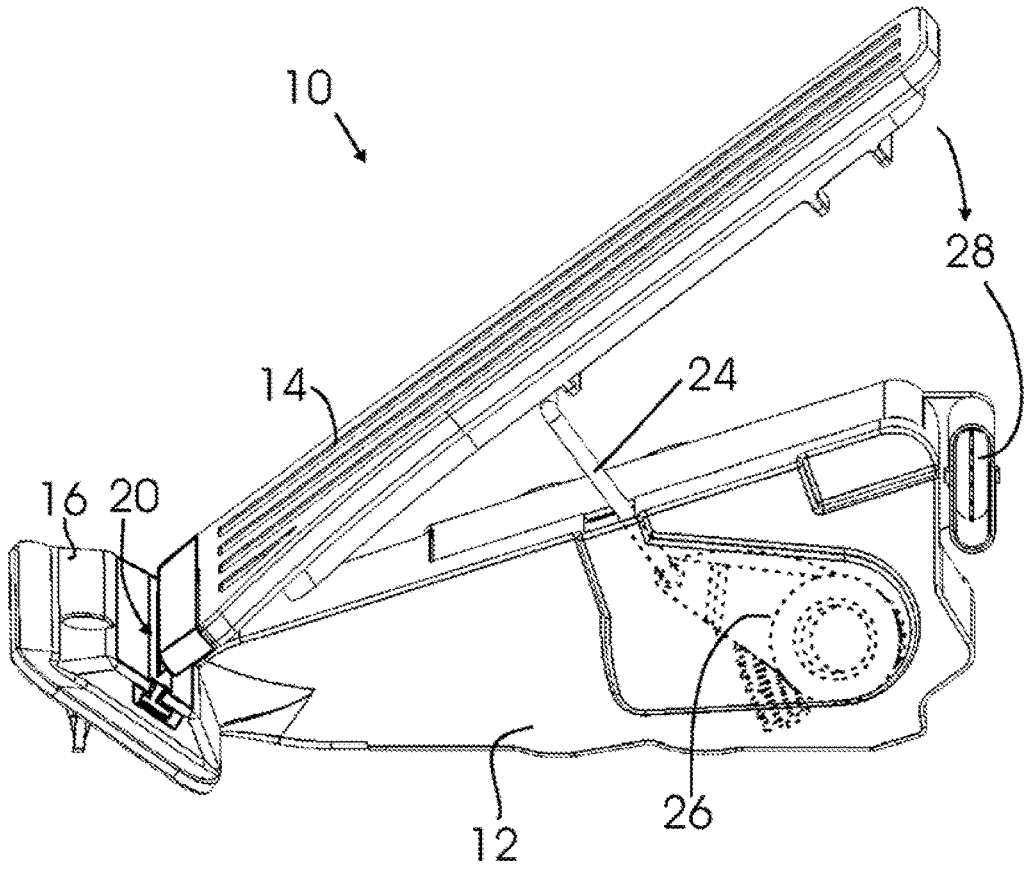
FIG. 1 depicts a perspective view of one embodiment of a pedal device.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a pedal device for use with automotive vehicles. A problem to be solved can be considered to be that of providing a particularly simple and cost-effective pedal device, in the case of which a stable articulation is nevertheless provided. The problem is solved by a pedal device according to example embodiments disclosed herein, or variants thereof.

In some embodiments, the pedal device includes a base element and a pedal element which is pivotably moveable relative to the base element. The base element is provided for the fixed arrangement, for example, in a footwell of an engine-driven vehicle, for example, a passenger vehicle, a commercial vehicle, or an industrial truck. The pedal element includes an area for the foot operation, in particular, a pedal plate. The pedal element is pivotably connected to the base element via a hinge part.

It was taken into account that a pedal device, on the one hand, should be durable with respect to high dynamic loads, for example, in the event of instantaneously high force effects on a pedal plate. On the other hand, a pedal device is subject to a continuous movement in the hinge area. According to example aspects of the present disclosure, the hinge part is designed as a belt band, wherein a first section thereof is fastened to the base element and a second section is fastened to the pedal element.

A belt band is understood to be a flat, planar material made of fibers, preferably in the form of woven fabric. The belt band can include plastic fibers or can be primarily made of plastic fibers.

In some embodiments, the belt band can have sufficient flexibility to allow for the pivotal movement of the pedal element with respect to the base element. Simultaneously, good stability can be achieved, in particular, in the case of a relatively short belt band, as described in greater detail below. A belt band, due to its structure of individual fibers, is highly resistant to tearing. Thus, high dynamic loads, for example, impacts, can be captured without the hinge part beginning to tear or even the pedal element tearing away from the base element. A belt band is furthermore very well suited for being continuously moved and bent during the use of the pedal device without damage occurring due to material fatigue. Suitable materials for a belt band as a hinge part are diverse and are available at low cost and can be easily processed.

In some embodiments, the first and second sections of the belt band can be preferably formed by opposite ends of a short piece of belt band. The belt band can be fastened to the base element, and similarly to the pedal element, in various ways, for example, by clamping, bonding, etc. The fastening can take place, for example, in a form-locking or integrally joined manner in each case. For example, a thickening can be formed on the belt band, which is fastened to the base element and/or to the pedal element, for example, being accommodated in a receptacle. The thickening can be formed, in particular, as one piece with the belt band. For example, a thickening can be formed by turning over, interweaving, or inserting an element into the belt band, for example, a pin, an axle or the like made of plastic, metal, or another material. A thickening can also be formed from the fiber material of the belt band itself, for example, by turning over, rolling up, folding, etc., and/or via thermal treatment, possibly including a fusion of the fibers and/or melting fibers together.

According to some example embodiments of the present disclosure, a fastening can preferably take place via embedding. For example, the first section can be embedded into the material of the base element or into the material of a first fastening element accommodated on or fastened to the base element. Alternatively or additionally, the second section can be embedded into the material of the pedal element or a second fastening element provided or formed there.

In this example, the base element and/or the pedal element as well as a fastening element, if necessary, are preferably formed from a plastic material. The embedding into the plastic material can take place, for instance, in the plastic injection molding process via extrusion-coating of the particular section. For example, the base element and/or the pedal element or a first or a second fastening element can be produced as a plastic injection-molded part directly, including extrusion coating of a section of the belt band.

In some embodiments, the free length of the belt band between the base element and the pedal element can be selected to be relatively short. In particular, in the case of the embedding of one or both ends, the embedded length is greater than the free length of the belt band.

In some embodiments, in order to achieve a particularly good fastening of the belt band, at least one opening can be provided in at least one of the sections of the belt band, and so a form-locking fastening is made possible by way of an element extending through the opening. In this example, in particular, of the embedding in the surrounding material, the material can form a positive fit with the belt band through the opening. Therefore, at least one section of the belt band including one or several openings or holes provided therein can be accommodated in the surrounding material in a form-locking manner. For example, a plurality of openings or holes can be provided next to one another in the belt in the transverse direction, for example, in a row or even offset with respect to one another.

In some embodiments, the first section of the belt band can be fastened to a first fastening element which can be accommodated, in a form-locking manner, in a receptacle of the base element. The first fastening element can be formed, for example, as a fastening strip, or, for example, as a thickening of the belt band. The fastening element can be, for example, latched on the base element or inserted into a receptacle. For example, the belt band can be guided through a passage, for example, a slot. The fastening element can be designed, with respect to its dimensions and/or its shape, in such a way that it cannot be guided through the passage, but rather is blocked at the passage. In some embodiments, the fastening element can be slid, in a form-locking manner, into a receptacle. In general, it is also possible to fix the first fastening element to the base element with the aid of a detent or snap-in connection, in particular, a detachable connection. The fastening of the second section to the pedal element can also be formed in one of the above-described ways.

In some embodiments, it can be possible undetachably fasten the second section of the belt band to the pedal element via embedding, in particular via extrusion-coating, but to detachably fasten the first section to the base element, for example, with the aid of a first fastening element accommodated in a form-locking manner in a receptacle. The assembly is simplified in this manner. In addition, it can be possible to separate the pedal element, including the hinge part, from the base element and replace it, for example, when damaged.

In example embodiments of the belt band, the belt band is designed to be relatively short and, simultaneously, relatively wide, in order to achieve good lateral stability. In particular, the free length of the belt band can be less than 20% of the width, such as less than 10%. In some embodiments, an even shorter belt band having a free length of less than 5% of the width can also be used.

Highly diverse materials and material thicknesses can be utilized for the belt band. In particular, the thickness of the belt band can have values of, for example, 0.5 mm to 5 mm, such as between 1 mm to 3 mm. The width of the belt band can be, for example, 45 mm to 75 mm.

For the rest, a pedal device equipped with a belt band as a hinge part can include all elements, features, and additional designs which are known for conventional pedal devices, for example, comprising film hinges. In particular, a device can be provided for registering the degree of the deflection of the pedal element with respect to the base element, for example, as a mechanical tap, preferably as a sensor, which delivers an appropriate electrical signal. Preferably, a coupling to a restoring element and/or a sensor on the base element can be provided on the pedal element.

FIG. 1 shows a perspective representation of an example embodiment of a pedal device 10 including a base element 12 and a pedal element 14, in the form of a pedal plate, which is pivotably moveable with respect to the base element 12. The base element 12 comprises a foot part 16, at which the articulation of the pedal plate 14 is formed by a hinge 20.

Figure 2:
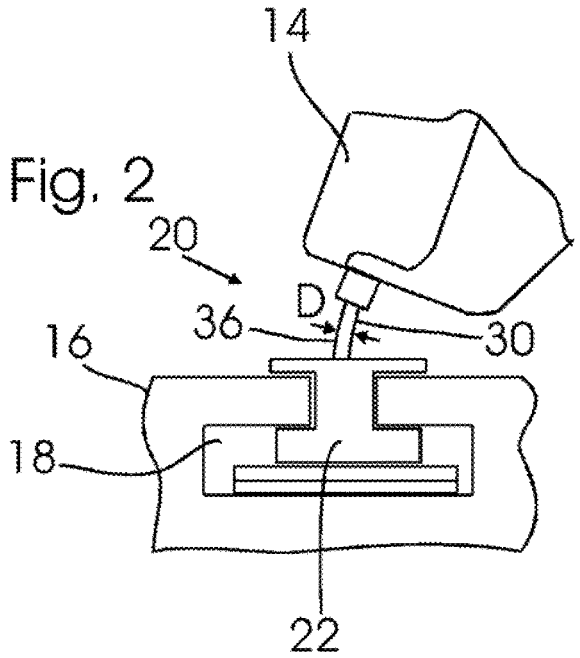
FIG. 2 depicts a side view of a hinge area of the pedal device of FIG. 1.
Figure 3:
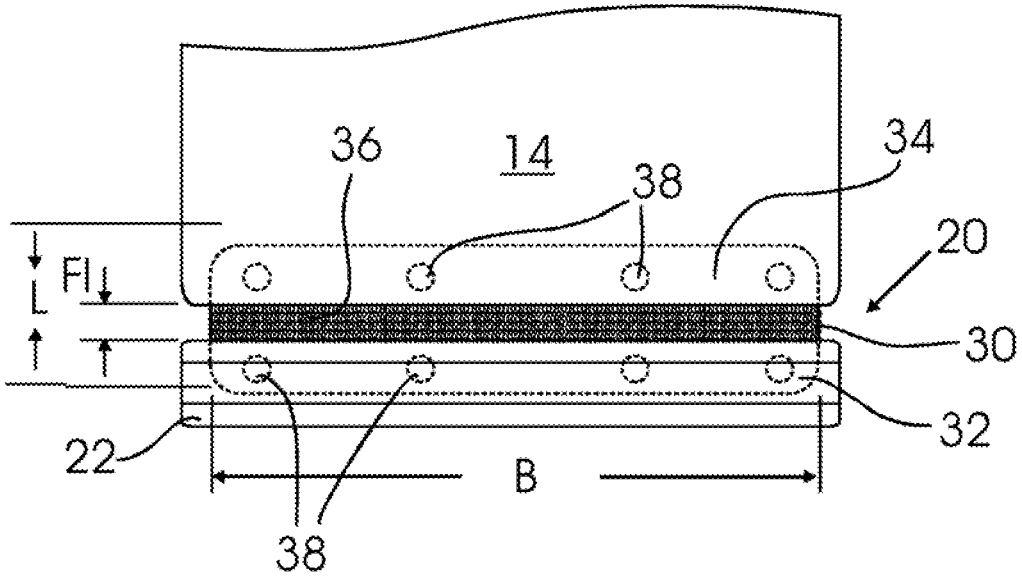
FIG. 3 depicts a top view of the hinge area from FIG. 1 and FIG. 2.

As represented in FIGS. 2 and 3, the hinge 20 is formed by a short piece of belt band 30 which connects the pedal element 14 and a fastening element 22 which is fixed, in a form-locking manner, in an accommodating slot 18 in the foot part 16 of the base element 12. The belt band 30 is a piece of solid woven fabric made of plastic fibers. As is clear from FIG. 3, the piece of belt band 30 includes a first end section 32, which is embedded into the fastening element 22 designed as a profile strip, and a second end section 34 positioned opposite thereto, which is embedded into the material of the pedal plate 14. Therebetween, the belt band 30 includes a free area 36.

The piece of belt band 30 has an essentially rectangular shape and, overall, has a length L and a width B. As represented, the length L is less than the width B. For example, in one embodiment, the width B can be 60 mm and the length L can be 20 mm. In one embodiment, the thickness D of the belt band 36 can be, for example, 2 mm.

The free area 36 of the belt band 30 has a free length Fl which is preferably less than one-half the total length L, further preferably less than one-third the total length L. The free length Fl is selected to be as short as possible in order to achieve a preferably good stability of the hinge 20 which is formed. The lower limit in this case is the length required for the pedal plate 14 to be moveable with respect to the base element 12. In one embodiment, the free length Fl can be, for example, 3 mm or 4 mm.

The belt band 30 is undetachably fastened to the pedal plate 14 and to the fastening element 22 by having been embedded into the material of the pedal plate 14 and of the fastening element 22. The fastening element 22 and the pedal plate 14 consist of plastic material and are produced via plastic injection molding, wherein the belt band 30 is extrusion-coated and, in this way, is embedded.

In this case, holes 38 are provided in the belt band, in both end sections 32, 34, which penetrate the woven fabric of the belt band 30, wherein the woven fabric is completely closed around the holes 38, however. A form-locking composite therefore results during the embedding into the plastic material of the fastening element 22 and of the pedal plate 14.

The pedal device 10 is utilized in a motor vehicle in the conventional way, in that the base element 12 is fixedly arranged in the footwell of the motor vehicle. Due to the articulation in the hinge 20, the pedal plate 14 can pivot. With the aid of a coupling 24, the pedal plate 14 is connected to elements 26 (merely indicated in FIG. 1) in the interior of the base element 12 in such a way that, on the one hand, springs, as restoring elements, act on the pedal plate 14 in the direction of a normal position and, on the other hand, the degree of the deflection out of the normal position is ascertained by a sensor and is output as an electrical sensor value at an output 28.

During the manufacture of the pedal device 10, the fastening element 22 and the pedal plate 14 are produced as a unit, in the injection-molding process, with the belt band 30 embedded, in sections, in the fastening element 22 and the pedal plate 14. The pedal plate 14 is then mounted on a separately produced base element 12, in that the fastening element 22 is slid laterally into the slot-shaped receptacle 18 of the foot part 16 and, thereafter, the coupling 24 is connected to the pedal plate 14.

The above-described embodiment is merely one example of the use of a belt band 30 for forming a hinge 20 on a pedal device 10 and is not to be understood to be limiting. In particular, the representations are not true to scale; in fact, the dimensions, in particular, of the belt band 30, can vary within wide ranges, provided the result thereof is that the function of the formation of a hinge 20 with sufficient stability is still achieved.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A pedal device comprising:

a base element; and a pedal element pivotably moveable with respect to the base element;

wherein the pedal element is connected to the base element via a hinge;

wherein the hinge comprises a belt band including a first section and a second section, wherein the first section is fastened to the base element and the second section is attached to the pedal element, wherein said belt band is a flat material made of fibers, and wherein the fibers are in the form of woven fabric.

2. The pedal device of claim 1, wherein the first section is embedded into a material of a first fastening element accommodated on the base element.

3. The pedal device of claim 2, wherein the second section is embedded into a material of a second fastening element accommodated on the pedal element.

4. The pedal device of claim 1, wherein the second section is embedded into a material of the pedal element.

5. The pedal device of claim 4, wherein the base element and the pedal element are produced as a plastic injection-molded part, the first section is extrusion-coated with the material of the base element, and the second section is extrusion-coated with the material of the pedal element.

6. The pedal device of claim 4, wherein a length of the embedded second section is greater than a free length of the belt band.

7. The pedal device of claim 1, wherein on the first section, at least one opening is provided in the belt band and so the first section is accommodated in surrounding material in a form-locking manner.

8. The pedal device of claim 7, wherein a plurality of openings is provided next to one another in the belt band.

9. The pedal device of claim 1, wherein the first section of the belt band is fastened to a first fastening element; and the first fastening element is accommodated in a receptacle of the base element in a form-locking manner.

10. The pedal device of claim 9, wherein the first fastening element is a thickening on the belt band.

11. The pedal device of claim 9, wherein the first fastening element is a fastening strip; and the receptacle in the base element is a slot.

12. The pedal device of claim 1, wherein a free length of the belt band between the base and the pedal element is less than 20% of a width of the belt band.

13. The pedal device of claim 1, wherein a free length of the belt band between the base and the pedal element is less than 10% of a width of the belt band.

14. The pedal device of claim 1, wherein the belt band has a thickness (D) of 0.5 mm to 5 mm.

15. The pedal device of claim 1, wherein the belt band has a width of 45 mm to 75 mm.

16. The pedal device of claim 1, wherein at least one opening is provided in at least one of the sections of the belt band.

17. The pedal device of claim 16, wherein a plurality of opening is provided next to one another in the belt band.

* * * * *